US006622775B2

(12) United States Patent
Crafton et al.

(10) Patent No.: US 6,622,775 B2
(45) Date of Patent: Sep. 23, 2003

(54) METHOD AND APPARATUS FOR ASSISTING REMOVAL OF SAND MOLDINGS FROM CASTINGS

(75) Inventors: Scott P. Crafton, Marietta, GA (US); Paul M. Crafton, Kennesaw, GA (US); Volker R. Knobloch, Woodstock, GA (US); James L. Lewis, Jr., Kennesaw, GA (US); Ian French, Kennesaw, GA (US)

(73) Assignee: Consolidated Engineering Company, Inc.

( * ) Notice: Subject to any disclaimer, the term of this patent is extended or adjusted under 35 U.S.C. 154(b) by 86 days.

(21) Appl. No.: 09/852,256

(22) Filed: May 9, 2001

(65) Prior Publication Data

US 2002/0020511 A1 Feb. 21, 2002

Related U.S. Application Data

(60) Provisional application No. 60/202,741, filed on May 10, 2000.

(51) Int. Cl.[7] ..... B22D 29/00

(52) U.S. Cl. ..... 164/131; 164/132; 164/48; 164/501

(58) Field of Search ..... 164/131, 132, 164/48, 510, 511, 501, 404

(56) References Cited

U.S. PATENT DOCUMENTS

| | | | | |
|---|---|---|---|---|
| 2,385,596 A | | 10/1945 | Barnett | 34/13 |
| 2,385,962 A | | 10/1945 | Barnett | 34/13 |
| 2,813,318 A | | 11/1957 | Horth | 22/89 |
| 2,988,351 A | | 6/1961 | Barnett et al. | 263/40 |
| 3,351,687 A | | 11/1967 | Thome et al. | 432/133 |
| 3,534,946 A | | 10/1970 | Westerkamp et al. | 263/28 |
| 3,737,280 A | | 6/1973 | Cromp | 432/14 |
| 3,760,800 A | | 9/1973 | Staffin et al. | 128/24.1 |
| 3,871,438 A | | 3/1975 | Vissers et al. | 164/5 |
| 3,993,420 A | * | 11/1976 | Haas et al. | 425/127 |
| 4,068,389 A | | 1/1978 | Staffin et al. | 34/57 A |
| 4,140,467 A | | 2/1979 | Ellison et al. | 432/72 |

(List continued on next page.)

FOREIGN PATENT DOCUMENTS

| | | | |
|---|---|---|---|
| CA | 1197981 | 12/1985 | 38/18 |
| DE | 1 030 974 | 9/1955 | |
| DE | 2307773 | 2/1973 | |

(List continued on next page.)

OTHER PUBLICATIONS

Economical Used Energy Type Continuing Heat Treating Furnace For Aluminum Castings Dogyo—Kanetsu vol. 21 No. 2 pp. 29–36—Mar. 1984.

(List continued on next page.)

*Primary Examiner*—M. Alexandra Elve
*Assistant Examiner*—I.-H. Lin
(74) *Attorney, Agent, or Firm*—Womble Carlyle Sandridge & Rice, PLLC

(57) ABSTRACT

Disclosed is a method for dislodging a mold from a casting formed within the mold. The mold may be removed from the casting by scoring the mold and applying a force sufficient to cause the mold to fracture and break into pieces. Additionally, the mold may be fractured by either explosive charges placed in the mold pack or by high energy pulsations directed at the mold. Once the mold is fractured and broken into various pieces it may then be dislodged from the casting.

42 Claims, 4 Drawing Sheets

U.S. PATENT DOCUMENTS

| | | | | |
|---|---|---|---|---|
| 4,161,389 | A | 7/1979 | Staffin et al. | 432/58 |
| 4,177,952 | A | 12/1979 | Rikker | 241/40 |
| 4,211,274 | A | 7/1980 | Slowinski et al. | 164/401 |
| 4,242,077 | A | 12/1980 | Hyre | 431/19 |
| 4,294,436 | A | 10/1981 | Takahashi | 266/257 |
| 4,325,424 | A | 4/1982 | Scheffer | 164/5 |
| 4,340,433 | A | 7/1982 | Harding | 148/16 |
| 4,392,814 | A | 7/1983 | Harding | 431/170 |
| 4,411,709 | A | 10/1983 | Nakanishi | 148/3 |
| 4,415,444 | A | 11/1983 | Guptail | 209/3 |
| 4,427,375 | A | 1/1984 | Di Rosa | 432/58 |
| 4,457,352 | A | 7/1984 | Scheffer | 164/5 |
| 4,457,788 | A | 7/1984 | Staffin et al. | 148/20.3 |
| 4,478,572 | A | 10/1984 | Selli | 432/13 |
| 4,490,107 | A | 12/1984 | Kimura et al. | 432/11 |
| 4,499,940 | A | 2/1985 | Hall | 164/36 |
| 4,512,821 | A | 4/1985 | Staffin et al. | 148/16.5 |
| 4,519,718 | A | 5/1985 | Staffin et al. | 374/45 |
| 4,524,957 | A | 6/1985 | Staffin et al. | 266/252 |
| 4,544,013 | A | 10/1985 | Kearney et al. | 164/5 |
| 4,547,228 | A | 10/1985 | Girrell et al. | 148/16 |
| 4,577,671 | A | 3/1986 | Stephan | 164/401 |
| 4,579,319 | A | 4/1986 | Sasaki | 266/252 |
| 4,582,301 | A | 4/1986 | Wunning | 266/87 |
| 4,604,055 | A | 8/1986 | Mackenzie | 432/58 |
| 4,613,713 | A | 9/1986 | Staffin et al. | 585/241 |
| 4,620,586 | A | 11/1986 | Musschoot | 164/253 |
| 4,623,400 | A | 11/1986 | Japka et al. | 148/6.35 |
| 4,627,814 | A | 12/1986 | Hattori et al. | 432/128 |
| 4,648,836 | A | 3/1987 | Thom | 432/107 |
| 4,671,496 | A | 6/1987 | Girrell et al. | 266/78 |
| 4,681,267 | A | 7/1987 | Leidel et al. | 241/23 |
| 4,700,766 | A | 10/1987 | Godderidge | 164/5 |
| 4,779,163 | A | 10/1988 | Bickford et al. | 361/212 |
| 4,802,525 | A * | 2/1989 | Heine et al. | 164/48 |
| 4,830,605 | A | 5/1989 | Hodate et al. | 431/170 |
| 4,955,425 | A | 9/1990 | McKenna | 164/269 |
| 5,018,707 | A | 5/1991 | Hemsath et al. | 266/254 |
| 5,052,923 | A | 10/1991 | Peter et al. | 432/207 |
| 5,169,913 | A | 12/1992 | Staffin et al. | 526/65 |
| 5,239,917 | A | 8/1993 | Lutkie et al. | 99/443 C |
| 5,251,683 | A * | 10/1993 | Backer | 164/98 |
| 5,253,698 | A | 10/1993 | Keough et al. | 164/269 |
| 5,263,652 | A * | 11/1993 | Iwanami et al. | 241/57 |
| 5,294,094 | A | 3/1994 | Crafton et al. | 266/44 |
| 5,350,160 | A | 9/1994 | Crafton et al. | 266/252 |
| 5,354,038 | A | 10/1994 | Crafton | 266/44 |
| 5,378,434 | A | 1/1995 | Staffin et al. | 422/141 |
| 5,423,370 | A | 6/1995 | Bonnemersou et al. | 164/132 |
| 5,439,045 | A | 8/1995 | Crafton | 164/5 |
| 5,443,383 | A | 8/1995 | Kuehn | 432/128 |
| 5,531,423 | A | 7/1996 | Crafton et al. | 266/44 |
| 5,551,998 | A | 9/1996 | Crafton et al. | 148/538 |
| 5,565,046 | A * | 10/1996 | Crafton et al. | 148/538 |
| 5,738,162 | A | 4/1998 | Crafton | 164/5 |
| 5,829,509 | A | 11/1998 | Crafton | 164/5 |
| 5,850,866 | A | 12/1998 | Crafton | 164/5 |
| 6,042,369 | A | 3/2000 | Bergman et al. | 432/15 |
| 6,112,803 | A | 9/2000 | Kruger | 164/103 |

FOREIGN PATENT DOCUMENTS

| | | | |
|---|---|---|---|
| DE | 2315958 | 4/1974 | B08B/5/00 |
| DE | 2337894 | 11/1974 | B08B/7/04 |
| DE | 2914221 | 4/1979 | |
| DE | 3206048 | 2/1982 | |
| DE | 3215809 | 4/1982 | B22D/29/00 |
| DE | 4012158 | of 1989 | 164/5 |
| DE | 195 30 975 | 2/1997 | B22C/5/00 |
| EP | 0 077 511 | 10/1982 | B22D/29/00 |
| EP | 0546210 A1 | 6/1993 | B22D/29/00 |
| FR | 7043571 | 12/1970 | |
| FR | 2448573 | 2/1979 | C21D/9/00 |
| GB | 1392405 | 4/1975 | |
| GB | 1564151 | 4/1980 | |
| GB | 1569152 | 6/1980 | |
| GB | 2137114 | 10/1984 | B01J/268/36 |
| GB | 2187398 | 9/1987 | F27B/15/09 |
| GB | 2230720 | 10/1990 | B22D/29/00 |
| GB | 2248569 | 4/1992 | B22D/29/00 |
| JP | 5653867 | 5/1981 | |
| JP | 5939464 | 8/1982 | |
| JP | 5825417 | 2/1983 | C21D/1/00 |
| JP | 5825860 | 2/1983 | |
| JP | 59219410 | 12/1984 | |
| JP | 6092040 | 5/1985 | 164/132 |
| JP | 2074022 | 9/1985 | |
| JP | 61007058 | 1/1986 | B22D/29/00 |
| JP | 62110248 | 5/1987 | |
| JP | 6316853 | 1/1988 | 164/132 |
| JP | 63108941 | 5/1988 | |
| JP | 1-91957 | 4/1989 | 164/132 |
| JP | 1-122658 | 5/1989 | B22D/29/00 |
| JP | 2104164 | 8/1990 | |
| JP | 3-465 | 1/1991 | B22D/29/00 |
| SU | 1129012 | 7/1982 | |
| SU | 0234810 | 3/1985 | 164/132 |
| WO | WO 97/30805 | 8/1997 | |
| WO | WO 98/14291 | 4/1998 | |
| WO | WO 01/08836 A1 | 2/2001 | B22D/29/00 |

OTHER PUBLICATIONS

Brochures describing Beardsley & Pipe PNEU–Reclaim Sand Reclamation Units Prior to Aug. 13, 1992.

Brochure describing Fataluminum Sand Reclamation Units—Prior to Aug. 13, 1992.

Paul M. Crafton—Heat Treating Aging System Also Permits Core Sand Removal—Reprinted from 09/89 Modern Castings magazine.

Preliminary Remarks dated Jul. 30, 1991 and filed in Ser. No. 07/705,626.

Declaration of Paul M. Crafton & Scott P. Crafton dated Jul. 26, 1991 and filed in Serial No. 07/705,626.

On Sale Description regarding System of Consolidated Engineering System (before Aug. 13, 1992).

Sales brochure describing Thermfire Brand Sand Reclamation, Gudgeon Bros., Ltd. believed to be known to others prior to 09/89.

Sales brochure describing Simplicity/Richards Gas–Fired Thermal Reclamation System Simplicity Engineering, Inc.—believed to be known to others prior to 09/89.

Sales brochure describing AirTrac Brand Fluidizing Conveyor, Air Trac Systems Corp., believed to be known to others prior to 09/89.

Sales brochure describing Fluid Bed Calcifer Thermal Sand Reclamation Systems, Dependable Foundry Equipment Co.—Believed to be known to others prior to 09/89.

* cited by examiner

METHOD AND APPARATUS FOR ASSISTING REMOVAL OF SAND MOLDINGS FROM CASTINGS

CROSS-REFERENCE TO RELATED APPLICATION

This application claims the benefit of U.S. Provisional Application Ser. No. 60/202,741, filed May 10, 2000.

FIELD OF THE INVENTION

The present invention relates generally to the manufacturing of metal castings and more particularly to manufacturing castings within sand mold packs.

BACKGROUND

A traditional casting process for forming metal castings generally employs a mold or die, such as a permanent, metal die or a sand mold, having the exterior features of a desired casting, such as a cylinder head, formed on its interior surfaces. A sand core comprised of sand and a suitable binder material and defining the interior features of the casting is typically placed within the die to further define the features of the casting. Sand cores generally are used to produce contours and interior features within the metal castings, and the removal and reclaiming of the sand materials of the cores from the castings after the casting process is completed is a necessity.

Depending upon the application, the binder for the sand core and/or sand mold may comprise a phenolic resin binder, a phenolic urethane "cold box" binder, or other suitable organic binder material. The die or mold is then filled with a molten metallic alloy, which is allowed to cool to a certain, desired degree to cause the alloy to solidify. After the alloy has solidified into a casting, the casting is then moved to a treatment furnace or furnaces for further processing, including heat-treating, reclamation of the sand from the sand cores, and aging. Heat treating and aging are processes that condition metallic alloys so that they will be provided with different physical characteristics suited for different applications. Heat treating may include processing and/or thermal processing.

Sand molds and/or cores generally are removed from the casting prior to completion of heat treatment. The sand molds and/or cores are typically separated from their castings by one or a combination of means. For example, sand may be chiseled away from the casting or the casting may be physically shaken or vibrated to break-up the sand molds and internal sand cores within the castings and remove the sand. In addition, as the sand molds and castings are passed through a heat treatment and/or thermal sand removal furnace, the organic or thermally degradable binder for the sand molds and cores, generally is broken down or combusted by exposure to the high temperatures for heat treating the castings to a desired metal properties so that the sand from the molds and cores can be removed from the castings and reclaimed, leaving the finished, heat-treated castings. Such furnace systems and methods of heat treating castings are found in U.S. Pat. Nos. 5,957,188, 5,829,509, and 5,439,045, each of which is expressly incorporated herein by reference. Once the sand is removed from the casting, heat treating and aging of the casting generally are completed in subsequent steps.

Technology such as that disclosed in the above mentioned patents is driven, for example, by competition, increasing costs of raw material, energy, labor, waste disposal, and environmental regulations. These factors continue to mandate improvements in the field of heat-treating and reclamation of sand from such metal castings.

SUMMARY

The present invention comprises a method and system for enhancing the removal of sand molds from castings formed within sand molds. According to one embodiment of the present invention, the sand molds may be removed from the castings by scoring the molds and applying a force sufficient to cause the mold to fracture and break into pieces. For example, the molds may be fractured by thermal expansion of the castings being heated therein by the application of radiant energy or inductive energy to the molds, or by other applications of force and/or energy. Additionally, a high-pressure fluid may be directed at the exterior walls of the mold to further aid in breaking down the mold. Once the molds are fractured and broken into various pieces they generally are then dislodged from the casting. After the molds have been removed, the castings may be heat treated while the pieces of the sand molds are heated to a temperature sufficient to cause the binder materials thereof to combust for breakdown and reclamation of sand from the molds and cores.

In a further embodiment, the method of dislodging a mold from a casting can include placing one or more explosive charges or organic or thermally degradable materials at one or more selected locations within exterior walls of the mold. The explosive charges are detonated at specific times in the process so as to cause the mold to fracture and break into pieces. The broken pieces may then be dislodged from the casting.

Additionally, score lines may be added to the mold containing the explosive charges or organic or thermally degradable or reactive materials. The score lines are operatively placed in combination with the explosive charge(s) and/or organic or thermally degradable materials in predetermined locations to enhance the breaking down and dislodging of portions of the mold from the casting upon initiation of the explosive charge(s). After the mold has been dislodged, heat treatment of the casting may begin or continue.

An additional embodiment includes a method of dislodging a mold from a casting formed within the casting by stimulating the mold with a high energy pulsation. The mold typically fractures after being stimulated by the high energy pulse and the fractured pieces may then be dislodged from the casting. The high energy pulsation typically includes a shock wave, pressure wave, acoustical wave, or combination thereof produced from either mechanical means, cannons, pressurized gasses and electromechanical means. Additionally, score lines may also be applied to the mold to aid in breaking down and dislodging the mold from the casting.

Various objects, features and advantages of the present invention will become apparent to those skilled in the art upon reading the following specification, when taken in conjunction with the accompanying drawings.

DETAILED DESCRIPTION

Figure 1A:
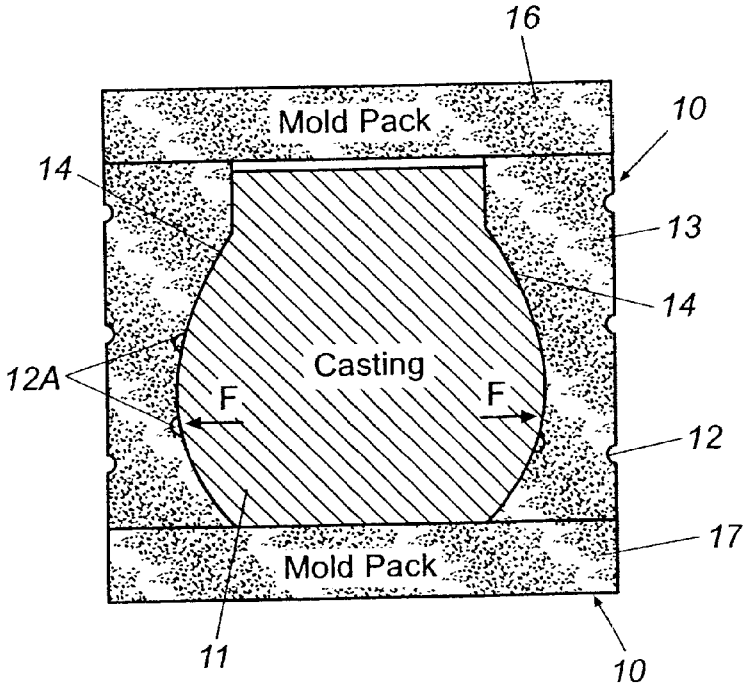
FIGS. 1A–1B are cross sectional views of a sand mold, illustrating the formation of score lines at desired locations thereon and the resultant fracture of the mold along the score lines.

The present invention generally comprises a method for enhancing the breakdown and removal of a sand mold from a casting formed within the mold to speed up the exposure of the casting to heat treatment temperatures and enhance the breakdown and reclamation of sand from the sand molds. The mold may be removed from around its casting either prior to the introduction of the sand mold and casting into a heat treatment furnace or unit, or within the heat treatment furnace or unit itself for heat treatment and sand reclamation within the unit. An example heat treatment furnace system for heat treatment of castings and at least partial breakdown and removal of sand molds and sand cores and reclamation of sand is shown in U.S. Pat. Nos. 5,294,994, 5,565,046, 5,738,162, and 5,957,188 and U.S. patent application Ser. No. 09/313,111, filed Jul. 27, 2000, the disclosures of which are incorporated by reference. By enhancing the breakdown and removal of the sand molds from their castings, the castings are more rapidly exposed to the ambient heating environment of the heat treatment furnace or chamber.

Less energy and time thus are required to increase the temperature of the casting to achieve the desired treatment and resulting metal properties of the casting when the mold is removed from the casting.

The method of dislodging a mold from a casting can include scoring the sand mold. The scored mold is typically a "precision sand mold" generally comprised of a foundry sand material and a phenolic resin, phenolic urethane, or other suitable organic binder that generally decompose and/or combust when exposed to heat treatment temperatures for treating most castings, as is conventionally known. The sand molds can also include semi-permanent type molds formed from a combination of standard binder materials and a metal such as steel. The mold typically fractures and breaks along the score lines set into the mold as the binder material combusts to facilitate the dislodging and removal of the mod from the casting contained therein. The score lines generally are placed at predetermined locations along or about the sides and/or top and bottom of each mold, with these locations generally selected to be optimal for breaking down the mold. The placing of the score lines in such predetermined locations is dependent upon the shape of the mold and the casting formed within the mold.

The term "scoring" can include any type of cut, line, scratch, indentation, groove or other such markings made into the top, bottom and/or side walls of the mold by any mechanism including cutting blades, milling devices and other, similar automatically and/or manually operated cutting or grooving devices. The scoring generally may take place on the exterior of the mold, but is not limited only to the exterior surfaces of the mold, and it will be understood that the interior surfaces of the mold also can be scored or grooved, in addition to or alternatively of the scoring of the exterior surfaces. Each mold may be scored by any conventional means such as by molded or scratched lines placed or formed on the exterior and/or interior surfaces of the mold during formation of the mold, or at some point thereafter, up to the introduction of the mold, with a casting therein, into a heat treatment furnace.

A force may further be applied to the mold to enhance the fracture and breaking of the mold into various pieces, which can then be easily dislodged or dropped away from the casting. Such a force may be applied to the inner walls of the mold, to the outer walls of the mold or a combination of the two. The force applied to the inner walls of the mold typically results from the thermal expansion of the casting within the mold, with the expansion of the casting further being enhanced or accelerated by heating the casting using radiant energy, inductive energy or a combination thereof. The energy sources used to heat the casting may include electromagnetic energy, lasers, radio waves, microwaves and combinations thereof.

The energy sources used to heat the mold and/or casting may also include lasers, radio waves, microwaves, or other forms of electromagnetic energy and/or combinations thereof. In general, these and other energy sources are radiated toward the exterior or directed to specific areas of the mold or casting for the purpose of heating the mold and casting to cause thermal expansion leading to mold and/or core sand fracture or breakdown. Alternately, inductive energy involves enveloping the casting and mold in a field of electromagnetic energy which induces a current within the casting leading to the heating of the metal, and to a lesser degree, the mold. Typically, with the molds being insulative rather than conductive, inductive energy generally offers some limited heating effect directly within the mold, but not to the degree of the heat generated within the casting. Of course there may be other methods of heating and expanding the casting for fracturing the molding. Additionally, score lines can be added to the mold or by the mold itself to aid in the dislodging of the mold from the casting or mold in conjunction with the application of force thereto.

Pulsations of energy also may be applied within specially designed process chambers such as for example a furnace. Design features may include the capability of withstanding pulsations and resultant effects, provide for the transportation of mold/casting into and out of the chamber to provide precise control of the pulsation. The energy pulsations generally enhance to some degree heat transfer to the mold cores and castings. The pulsations also promote mass transport of decomposed binder gases out of the mold and cores, oxygen bearing process gas to the mold and cores, and loosens sand out of the casting. The pulsations may occur at both low or high frequencies, where low frequency pulsations would generally be utilized to generate a force for fracturing the mold or cores and the higher frequencies would be employed to enhance the transfer, mass transport and some fracturing on a smaller scale. Higher frequency pulsations induce vibration effects to some degree within the casting to promote the mechanical effects of the above process.

Furthermore, the mold and/or cores may be broken down by the application of any or all of these energy sources to the mold and/or cores to promote the decomposition of the organic or thermally chemical binder of the sand mold and/or core, which binder breaks down in the presence of heat thus facilitating the degradation of the mold. Additionally, the mold may be broken down by the application of a high pressure fluid(s) such as air, products of combustion, oxygen enriched gases or other fluid materials to the exterior walls of the mold.

Furthermore, a direct application of force in the form of shock waves, pressure waves, acoustical waves, or a combination thereof can be applied to the mold, cores, or casting to aid in fracturing and breaking the mold into pieces. In one embodiment, the mold and/or core is stimulated with a high energy pulsation for direct application of a force, which may also penetrate the walls of the mold and cause heating of the mold to further aid in the combustion of the mold binder and the resultant breaking down of the mold. The pulsation energy may be a constantly recurring or intermittent force and can be in the form of shock waves, pressure waves, acoustical waves, or any combination thereof produced by mechanical, electromechanical and/or other known means such as compression cannons or pressurized gasses. Alternatively, low power explosive charges or organic or thermally degradable materials can be placed in the mold and set off or initiated by the heating of the mold to assist in break up and dislodging of the mold from about its casting.

In greater detail, the present invention envisions several alternative embodiments and/or methods for performing this function of dislodging or breaking up the sand molds prior to or during heat treatment of the castings. It will also be understood that any of the described methods can be used in conjunction with or separately from one another. These various methods are illustrated in FIGS. 1A through 5B.

Figure 1B:
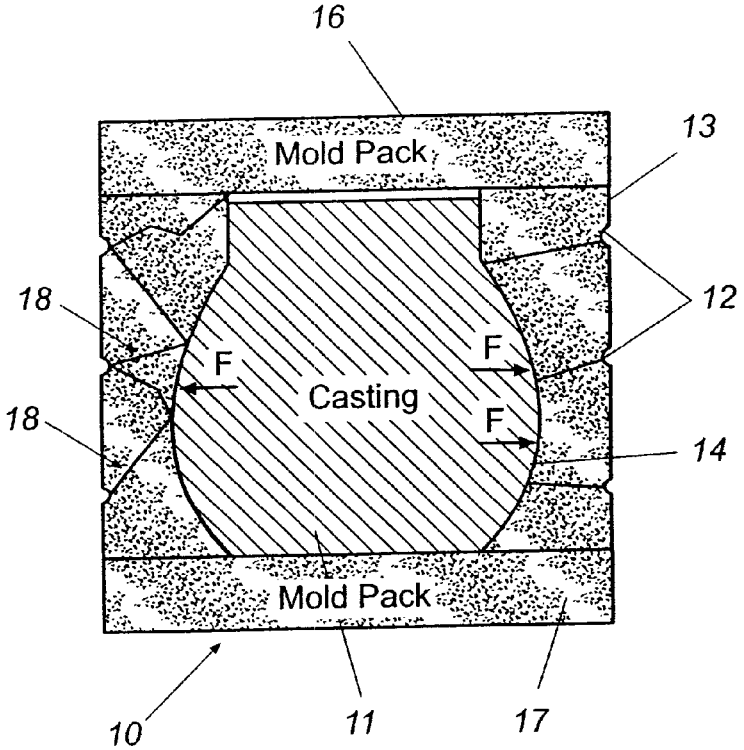

In a first embodiment of the invention illustrated in FIGS. 1A and 1B, a sand mold 10 with a casting 11 therein is shown with at least one, and typically multiple, score lines 12 or relief lines formed in the exterior side walls 13 of the mold 10. The score/relief lines 12 typically will be cut or otherwise formed as grooves or notches in the exterior side walls of the mold and act as break lines for the exterior walls of the mold pack. It is also possible to cut or form the score/relief lines 12A in the interior walls 14 of the mold as shown in FIG. 1A and/or in the top and bottom walls 16 and 17 of the mold 10.

As further illustrated in FIG. 1B, these score/relief lines weaken the mold walls so as to predetermine the locations and positions of the fracture or breaking apart of the mold 10, such that as a force F is applied to the walls of the mold, walls of the mold are caused to crack and break apart along these score/relief lines as illustrated at 18 in FIG. 1B. Typically, this force F includes the exertion of pressure against the interior walls 14 of the mold 10 by the castings themselves due to the thermal expansion of the metal of the castings as they are subjected to heating or elevated temperatures for heat treating the castings. As the metal of the castings expands in response to heat in the heat treatment furnace, it presses against and urges the walls of the mold outwardly, causing the mold to crack and break apart at the points of weakness therein created by the score/relief lines. As a result, sections or portions of the mold will be readily and easily dislodged from the mold and its casting generally prior to or during an initial phase of the heat treatment process for the castings, rather than the mold simply breaking down and slowly degrading as its binder material is combusted over time in the heat treatment furnace.

Figure 2A:
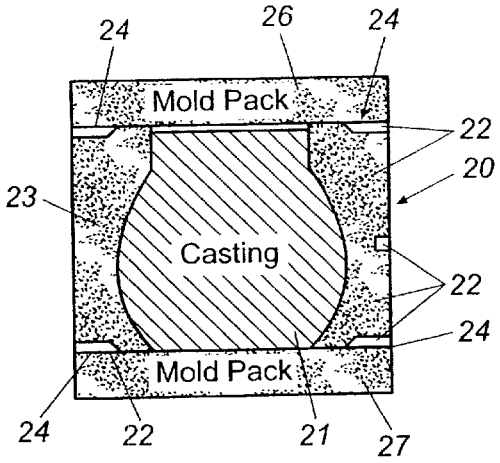
FIGS. 2A–2B are cross sectional views of a sand mold and casting, illustrating the use of score lines and explosive charges placed within the sand mold and fracture and dislodging of the mold upon initiation of the explosive charges.
Figure 2B:
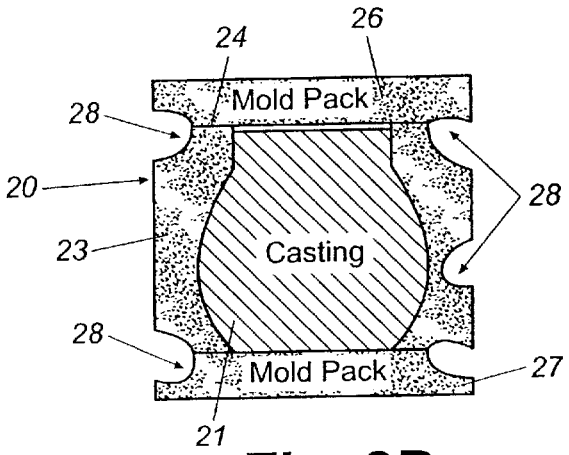

FIGS. 2A–2B illustrate an alternative embodiment of the present invention for breaking down and dislodging a mold 20 from a casting 21 formed therein. In this alternative method, low impact explosive charges 22 are mounted at one or more points within the side walls 23 of the mold pack 20. The explosive charges generally are strategically located within the mold pack structure, generally near critical joints 24 within walls, such as between the side walls 23 and the top and bottom walls 26 and 27, so as to dislodge the mold from the casting, while still retaining the casting intact. As additionally shown in FIG. 2B, after explosion of the low intensity explosive charges, gaps or channels 28 are formed in the mold pack 20, extending deeply through the side walls and upper and lower portions of the mold. As a result, the mold is substantially weakened at or along these channels or gaps such that the mold tends to readily break apart in sections or pieces along these channels 28 in response to presence from the thermal expansion of the castings and/or as the binder materials of the mold is combusted for ease of removal of the mold from its casting.

Figure 3:
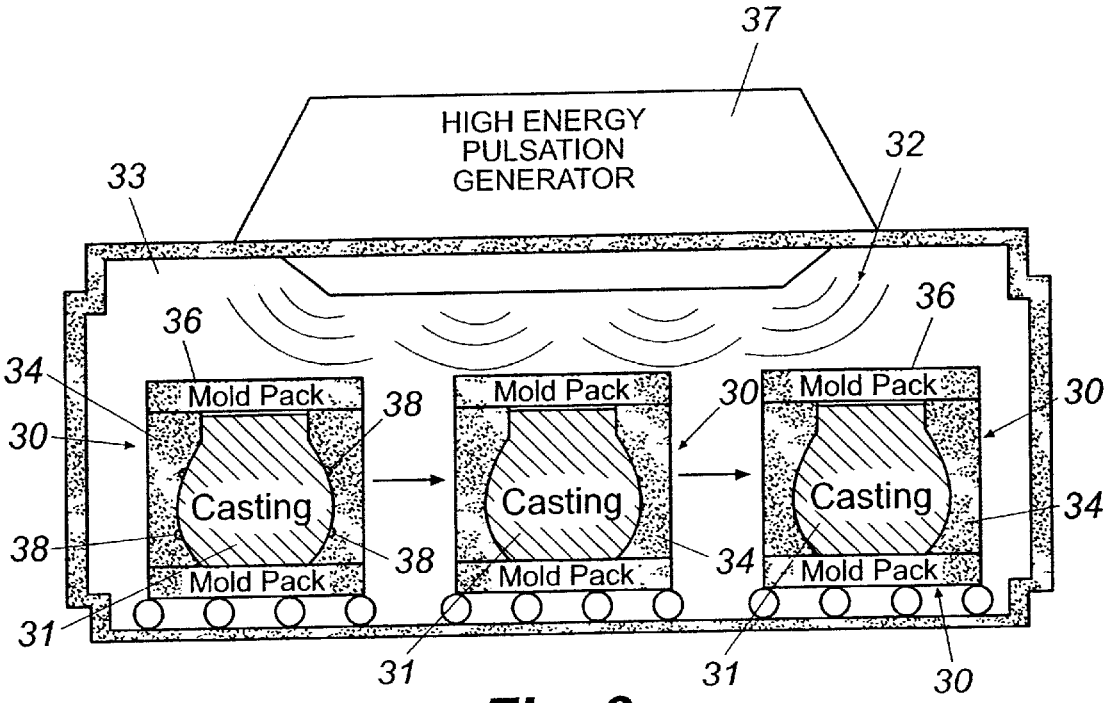
FIG. 3 depicts a cross sectional view of a mold passing though an energy pulse chamber within or adjacent a treatment furnace, illustrating the mold pack and casting being treated with high energy pulses.

Still a further embodiment of the present invention for breaking apart and enhancing the removal of mold 30 and from the castings is illustrated in FIG. 3. In this embodiment of the present invention, vibratory forces of nature to promote fracture of mold/core sand is applied to the molds in the high-energy pulses or waves 32 which are directed at the molds 30 as they are passed through a process chamber 33, which typically is positioned in front of or at the input end of a heat treatment furnace so that the molds and castings generally pass therethrough prior to heat treatment of the castings. The high-energy pulses of variable frequency or wavelength are typically directed at the side walls 34 and/or upper portions or top walls 36 of the molds from one or more pulsation or wave generators 37 mounted within the chamber. Such high energy pulsations or waves would typically be generated in the form of shock waves, pressure waves, or acoustical waves propagated through the atmosphere of the process chamber. Alternatively, electromagnetic energy could be pulsed or radiated onto the walls of the molds as described to promote fracture, heat absorption, binder degradation, or other process effect for the purpose of dislodging mold and core sand from the casting. Such electromagnetic radiation would be in the form of lasers, radio waves, microwaves, or other form that would result in the process effects described above.

The high energy pulses directed towards the molds stimulate the molds and cause them to vibrate without requiring physical contact with the mold packs. As the pulsations pass through the molds, the stimulation and vibration of the molds tends to cause fracturing and breaking apart of the molds. The pulsation may be either a sustained pulse or directed as discrete pulses. The discrete pulses may be administered at regular intervals. Pulsations administered in sustained or discrete fashion would be carefully controlled in terms of frequency, interval of application, and intensity, so as to accomplish the process effects without harming the casting. In addition, the molds can also be scored or prestressed/weakened, at selected points as discussed above and as indicated at 38 in FIG. 3, so as to facilitate or promote the breaking apart of the molds as they are vibrated or otherwise impacted by the high energy pulses. The molds accordingly are caused to be broken down and dislodged from their castings as the castings are moved into a heating chamber of the heat treatment furnace or other processing of the castings. In addition, as discussed in U.S. patent application Ser. No. 09/627,109, filed Jul. 27, 2000 and incorporated herein by reference, the energy pulses further typically cause the castings within the molds to be heated, which further results in thermal expansion of the castings so as to apply a force against the interior side walls of the molds to further facilitate and enhance the breaking apart of the molds.

Figure 4A:
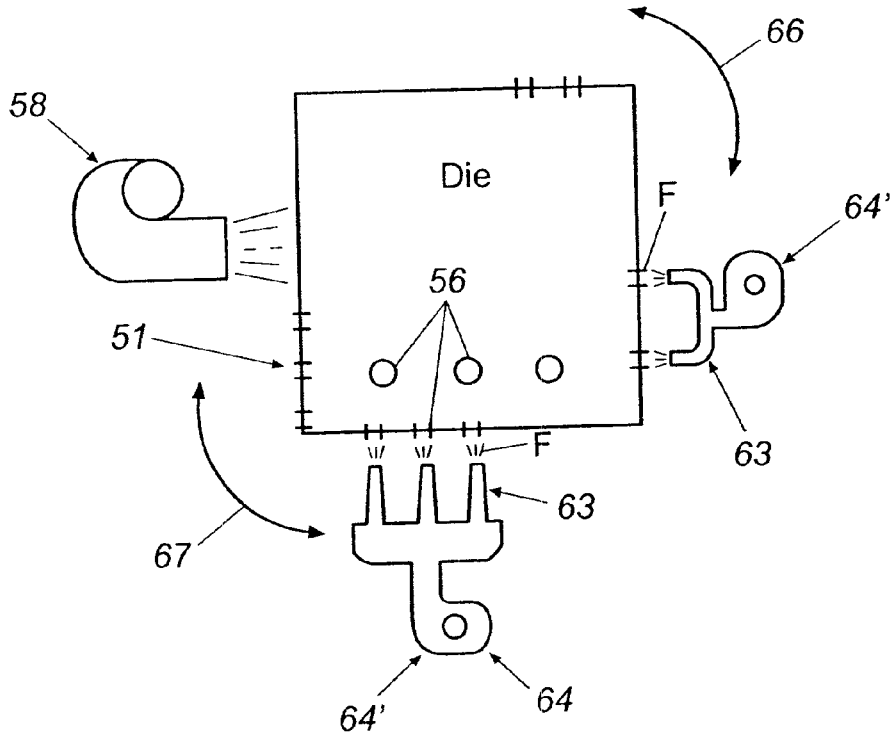
FIGS. 4A–4B illustrates the application of a pressurized fluid to a mold for breakdown of the mold.
Figure 4B:
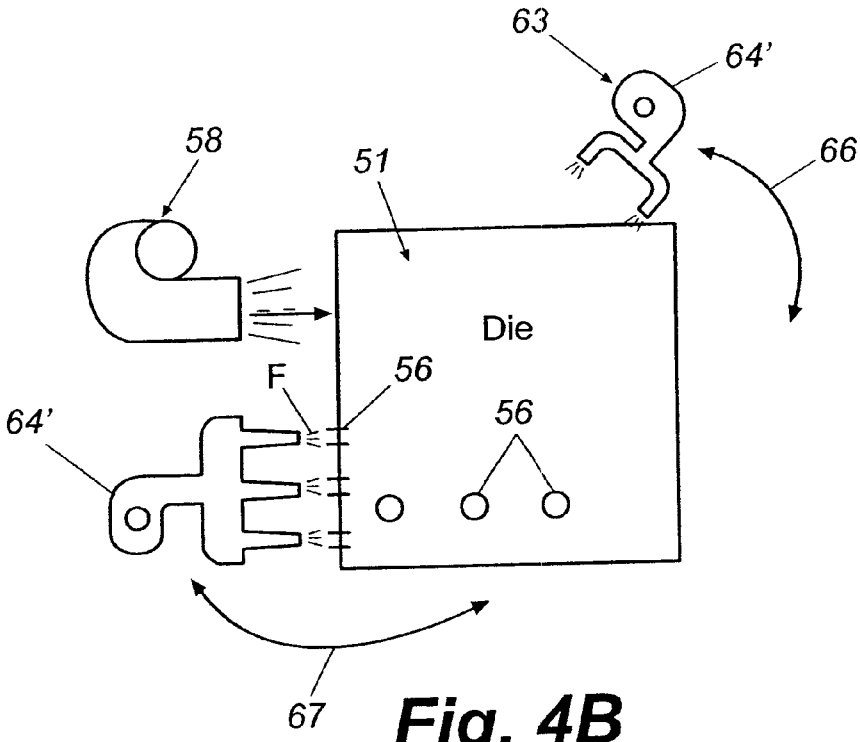

In still a further embodiment of the present invention for enhancing the breakdown and removal of a sand mold from a casting 51 formed therein (or, for example, as discussed in regard to this embodiment, removal of sand cores located within the casting) as illustrated in FIGS. 4A–4B, a series of nozzle stations 42 generally are positioned at specific locations or positions along the path of travel of the mold/core laden casting into or within a heat treatment furnace, either as a part of the heat treatment furnace, such as in an initial or prechamber, or placed in front of or prior to the heat treatment furnaces, to aid in the removal of the sand core from the castings. The number of nozzle stations can vary as needed, depending upon the core print or design of the casting being formed in the mold. Each of the nozzle stations or assemblies 42 generally includes a series of nozzles 43 mounted and oriented at known or registered positions about the side walls 44, top or upper walls 46 and/or lower or bottom walls 47 of the molds 40 corresponding to known, indexed positions of the cores and castings 41. The number of nozzles in each nozzle station is variable, depending upon the core prints of the castings, such that different types of castings having differing core prints can utilize an optionally different arrangement or number of nozzles per nozzle station. The nozzles also may be automatically controlled through a control system for the heat treatment station or furnace that can be operated remotely to cause the nozzles to move to various desired positions about the side walls 44 and top and bottom walls 46 and 47 of the mold as indicated by arrows 48 and 48' and 49 and 49' in FIGS. 4A and 4B.

Each of the nozzles is typically supplied with a high-pressure heated media. The high-pressure media may include air, thermal oils, water or other known fluid materials that are directed at the side walls 44, top wall 46 and/or bottom wall 47 of each mold/core under high pressure, typically in the range of 5 psig to 45 psig, although greater or lesser pressures also can be used as required for the particular casting application. These fluid pressures are converted to high fluid velocities at the nozzle exit which delivers the energy of the fluid to the mold/core and applies forces sufficient to at least partially fracture and/or otherwise degrade the mold and/or cores. High fluid velocities typically cause or promote higher heat transfer to the casting, mold, and cores which has added benefit in breaking down mold and core sands. The pressurized fluid flows, which are administered by the nozzles, can be applied in continuous flows or as intermittent blasts that impact or contact the mold walls to cause the mold walls to fracture or crack and can promote more rapid decomposition and/or combustion of the binder materials of the sand molds to help at least partially degrade or break down the mold.

Figure 5A:
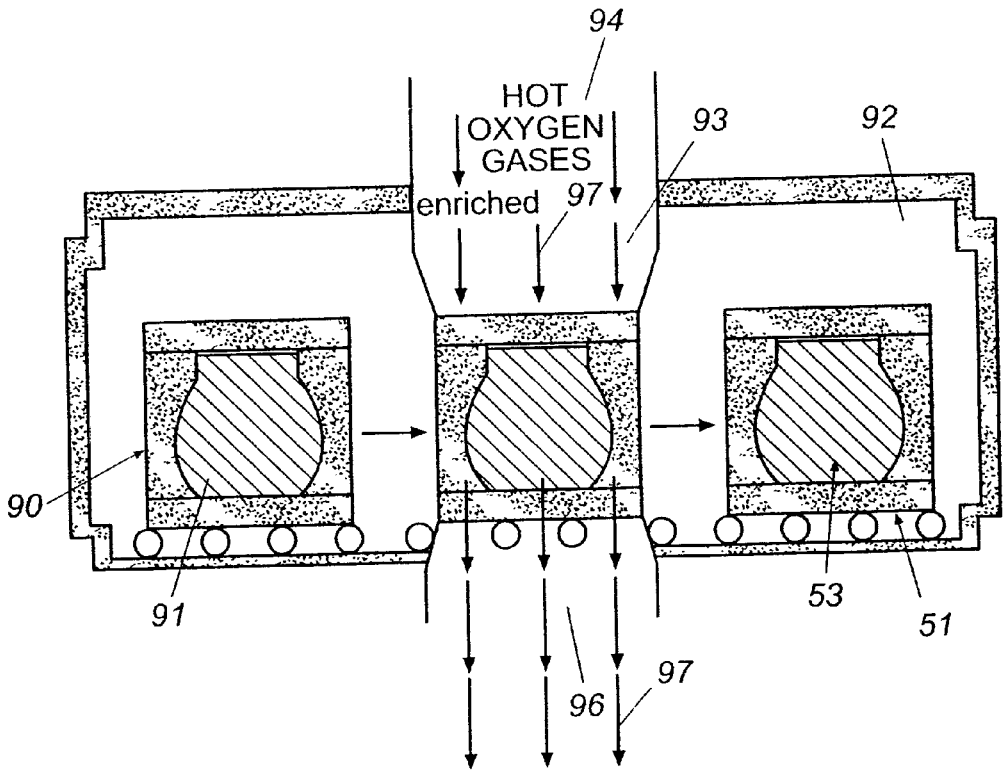
FIGS. 5A–5B illustrates movement of the molds through an oxygen enriched chamber for applying a flow of oxygen to promote combustion of the organic or thermally degradable binder of the molds.
Figure 5B:
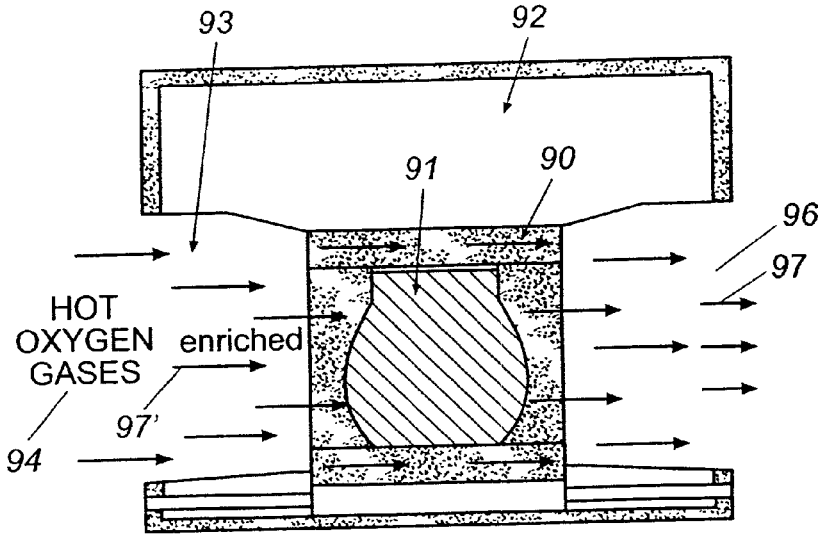

FIGS. 5A–5B illustrate still a further alternative embodiment of the present invention for enhancing the breakdown and removal of molds 90 from castings 91 contained therein. In this embodiment, prior to or as the molds 90 and their castings are moved into a heat treatment furnace or chamber 92, they are passed through a low velocity oxygen chamber 93. The oxygen chamber generally is an elongated autoclave or similar pressurized heating chamber capable of operating under higher than ambient pressures. The oxygen chamber 93 is provided with an enriched oxygenated environment and includes a high pressure upstream side 94 and a low pressure downstream side 96 that are positioned opposite each other to assist in drawing an oxygen flow therebetween.

As the molds are passed through the low velocity oxygen chambers of the heating chamber 93, heated oxygen gas is directed at and is forced through the molds, as indicated by arrows 97 (FIG. 5A) and 97' (FIG. 5B). The oxygen gas is drawn or flows under pressure from the high atmospheric pressure side to the low atmospheric pressure side of the oxygen chamber, so that the oxygen gas is urged or forced into and possibly through the molds and/or cores. As a result, a percentage of the oxygen gas is combusted with the binder materials of the sand molds/cores, so as to enhance the combustion of the binder material within the heating chamber. This enhanced combustion of the binder materials of the molds and cores are further supplied with energy from the enhanced combustion of the binder material thereof and the oxygen, which helps enhance and/or speed up the breakdown and removal of the molds from their castings. This breakdown of the molds can be further assisted by scoring or forming relief lines in the molds, as discussed in greater detail above, so as to prestress/weaken the molds so that as the binder materials are combusted, the mold walls will tend to crack or fracture so that the molds will break and fall away from their castings in sections or pieces.

In addition, the enhanced combustion of the binder materials further serves as an additional, generally conductive heat source to thus increase the temperature of the castings in the mold packs and facilitate combustion of the binder materials of the sand cores for ease of removal and reclamation. As a result, the castings are raised to their heat treatment temperatures more rapidly, which helps reduce the residence time of the castings in the heat treatment furnace that is required to properly and completely heat treat the castings, as discussed in copending U.S. patent application Ser. No. 09/627,109, filed Jul. 27, 2000, the disclosure of which is incorporated herein by reference.

It will be understood by those skilled in the art that while the present invention has been disclosed above with reference to preferred embodiments, various modifications, changes and additions can be made to the foregoing invention, without departing from the spirit and scope thereof.

What is claimed is:

1. A method of dislodging a mold from a casting formed therein, comprising:

scoring the mold to weaken the mold;

applying a force sufficient to cause the mold to fracture and break into pieces; and dislodging the pieces of the mold from the casting.

2. The method of claim 1, wherein the mold is scored by forming score lines in exterior walls of the mold.

3. The method of claim 2, wherein the score lines are placed in predetermined locations for breaking down and dislodging portions of the mold from the casting.

4. The method of claim 1, wherein the force sufficient to cause the mold to fracture includes thermal expansion of the casting bearing against the mold.

5. The method of claim 4, wherein the casting is expanded by heating the casting.

6. The method of claim 5, wherein the casting is heated by an energy source selected from the group consisting of radiant energy, inductive energy and combinations thereof.

7. The method of claim 6, wherein the energy source is selected from the group consisting of electromagnetic energy, lasers, radio waves, microwaves, and combinations thereof.

8. The method of claim 1, and wherein the mold is formed from sand and a degradable binder that is combusted as the mold is heated under elevated pressures in an enriched oxygen atmosphere to facilitate breakdown of the mold.

9. The method of claim 1, wherein the pieces of the mold are dislodged from the casting prior to heat treating the casting.

10. The method of claim 1, wherein the force sufficient to cause the mold to fracture includes directing a high pressure fluid at exterior walls of the mold.

11. The method of claim 10, wherein the high pressure fluid comprises heated air, thermal oils or water.

12. A method of dislodging a mold from a casting formed therein, comprising:

placing at least one explosive charge at a selected location within exterior walls of the mold;

detonating the explosive charge such that the mold fractures and breaks into pieces; and dislodging the pieces of the mold from the casting.

13. The method of claim 12, wherein the mold is comprised of sand and a binder.

14. The method of claim 12, and further including scoring the mold by forming score lines in exterior walls of the mold.

15. The method of claim 14, wherein the score lines are operatively placed in combination with the explosive charge in predetermined locations for breaking down and dislodging portions of the mold from the casting.

16. The method of claim 12, wherein the pieces of the mold are dislodged from the casting prior to heat treating the casting.

17. The method of claim 12, wherein dislodging the pieces of the mold comprises heating the casting to cause expansion of the casting.

18. The method of claim 17, wherein heating the casting comprises applying energy to the casting from an energy source selected from the group consisting of radiant energy, inductive energy and combinations thereof.

19. The method of claim 18, wherein the energy source is selected from the group consisting of electromagnetic energy, lasers, radio waves, microwaves, and combinations thereof.

20. The method of claim 12, and wherein the mold is formed from sand and a degradable binder that is combusted as and the mold is heated under elevated pressures in an enriched oxygen atmosphere to facilitate breakdown and dislodging of the mold from the casting.

21. The method of claim 12, and further including directing a high pressure fluid at exterior walls of the mold.

22. The method of claim 21, wherein the high pressure fluid comprises heated air, thermal oils or water.

23. A method of processing a casting, comprising:

moving the casting in a mold into a process chamber;

stimulating the mold with a high energy pulsation;

fracturing the mold;

dislodging the mold from the casting; and heat treating the casting.

24. The method of claim 23, wherein the high energy pulsation is applied as a shock wave.

25. The method of claim 23, wherein the shock wave is produced from at least one of the following: mechanical means, cannons, pressurized gasses and electromechanical means, and a combination thereof.

26. The method of claim 23, and further comprising scoring the mold by forming score lines in exterior walls of the mold.

27. The method of claim 26, wherein the score lines are operatively placed in predetermined locations for breaking down and dislodging portions of the mold from the casting.

28. The method of claim 23, wherein pieces of the mold are dislodged from the casting as the casting is heat treated.

29. The method of claim 23, wherein dislodging the mold from the casting includes heating the casting so as to cause the casting to expand.

30. The method of claim 29, wherein heating the casting comprises applying energy to the coating from an energy source selected from the group consisting of radiant energy, inductive energy and combinations thereof.

31. The method of claim 30, wherein the energy source is selected from the group consisting of electromagnetic energy, lasers, radio waves, microwaves, and combinations thereof.

32. The method of claim 23, and wherein the mold is formed from sand and a degradable binder and dislodging the mold from the casting comprises combusting the binder as the mold is heated under elevated pressures in an enriched oxygen atmosphere to facilitate breakdown of the mold.

33. The method of claim 23, wherein stimulating the casting with a high energy pulsation includes directing a high pressure fluid at exterior walls of the mold with a force sufficient to cause the mold to fracture.

34. The method of claim 33, wherein the high pressure fluid comprises heated air, thermal oils or water.

35. A method of dislodging a mold from a casting formed therein, comprising:

scoring the mold to weaken the mold;

directing a high pressure fluid at exterior walls of the mold; and dislodging pieces of the mold from the casting.

36. The method of claim 35, wherein the high pressure fluid comprises heated air, thermal oils or water.

37. The method of claim 35, wherein dislodging the pieces of the mold comprises heating the casting to cause expansion of the casting within the mold.

38. The method of claim 37, wherein heating the casting comprises directing energy through the mold at the casting with an energy source selected from the group consisting of radiant energy, inductive energy and combinations thereof.

39. The method of claim 38, wherein the energy source is selected from the group consisting of electromagnetic energy, lasers, radio waves, microwaves, and combinations thereof.

40. The method of claim 35, and wherein the mold is formed from sand and a degradable binder, and dislodging pieces of the mold from the casting includes combusting the binder of the mold as the mold is heated under elevated pressures in an enriched oxygen atmosphere to facilitate breakdown of the mold.

41. The method of claim 35, wherein the pieces of the mold are dislodged from the casting prior to heat treating the casting.

42. The method of claim 35, wherein the high pressure fluid directed at the exterior walls of the mold comprises heated air, thermal oils or water.

* * * * *